US011067023B2

(12) United States Patent
Tsuyuki

(10) Patent No.: US 11,067,023 B2
(45) Date of Patent: Jul. 20, 2021

(54) INTERNAL COMBUSTION ENGINE DIAGNOSTIC METHOD AND INTERNAL COMBUSTION ENGINE DIAGNOSTIC DEVICE

(71) Applicant: NISSAN MOTOR CO., LTD., Yokohama (JP)

(72) Inventor: Takeshi Tsuyuki, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 0 days.

(21) Appl. No.: 16/756,562

(22) PCT Filed: Oct. 23, 2017

(86) PCT No.: PCT/JP2017/038128
§ 371 (c)(1),
(2) Date: Apr. 16, 2020

(87) PCT Pub. No.: WO2019/082229
PCT Pub. Date: May 2, 2019

(65) Prior Publication Data

US 2021/0148299 A1 May 20, 2021

(51) Int. Cl.
*F02D 41/22* (2006.01)
*F02D 41/24* (2006.01)
*F02D 41/34* (2006.01)

(52) U.S. Cl.
CPC ..... *F02D 41/2454* (2013.01); *F02D 41/345* (2013.01)

(58) Field of Classification Search
CPC .... F02D 41/2454; F02D 41/345; F02D 41/22; F02D 41/221; F02D 41/222; F02D 2041/223; F02D 2041/224; F02D 2041/225; F02D 2041/226
USPC ..... 123/672, 673, 674; 701/103–105, 107
See application file for complete search history.

(56) References Cited

U.S. PATENT DOCUMENTS 10,260,440 B2 4/2019 Mano
10,711,722 B2 * 7/2020 Idogawa ..... F02D 41/0032

FOREIGN PATENT DOCUMENTS

JP 2005-48730 A 2/2005
JP 2005-214015 A 8/2005
JP 2006-138249 A 6/2006
JP 2007-231850 A 9/2007
(Continued)

*Primary Examiner* — Hai H Huynh
(74) *Attorney, Agent, or Firm* — Foley & Lardner LLP

(57) ABSTRACT

A prescribed air-fuel ratio feedback control region for performing feedback-control of air-fuel ratio has therein: a first region where fuel is injected, during one combustion cycle, only from a first fuel injection valve injecting fuel directly into a cylinder; and a second region where fuel is injected, during one combustion cycle, from both of the first fuel injection valve and a second fuel injection valve injecting fuel into an air-intake passage. A second region is configured such that an amount of fuel injected from the first fuel injection valve and an amount of fuel injected from the second fuel injection valve remain at a given constant ratio regardless of operating status. A diagnosis on the first and second fuel injection valves is performed by using a first air-fuel ratio learning value learned in the first region and a second air-fuel ratio learning value learned in the second region.

10 Claims, 4 Drawing Sheets

(56) References Cited

FOREIGN PATENT DOCUMENTS

| | | | |
|---|---|---|---|
| JP | 2008-95532 | A | 4/2008 |
| JP | 2011-112028 | A | 6/2011 |
| JP | 2014-218904 | A | 11/2014 |
| WO | WO 2016/203634 | A1 | 12/2016 |

* cited by examiner

INTERNAL COMBUSTION ENGINE DIAGNOSTIC METHOD AND INTERNAL COMBUSTION ENGINE DIAGNOSTIC DEVICE

TECHNICAL FIELD

The present invention relates to a diagnostic method for internal combustion engine and a diagnostic device for internal combustion engine.

BACKGROUND ART

Patent Document 1 discloses an internal combustion engine that includes a cylinder injection valve for direct fuel injection into a cylinder and includes an intake passage injection valve for fuel injection into an intake passage.

Patent Document 1 describes fixing a ratio of injection apportionment between the fuel injection from the intake passage injection valve (i.e. port injection) and the fuel injection from the cylinder injection valve (i.e. cylinder injection) in case that a temperature of cooling water is lower than a predetermined temperature.

Patent Document 1 further describes that, in case that the cooling water temperature is equal to or higher than the predetermined temperature, the injection apportionment ratio between the port injection and the cylinder injection is not fixed and is set appropriately depending on operating status at that moment.

However, according to Patent Document 1, both of the cylinder injection valve and the intake passage injection valve are always in operation for fuel injection, during fuel supply to the cylinder.

This precludes diagnosis for drift in injection characteristics of the cylinder injection valve or for drift in injection characteristics of the intake passage injection valve.

In other words, in an operating region in which the injection apportionment ratio is fixed, it is precluded to implement self-diagnosis for the drift in injection characteristics of each injection valve or self-diagnosis for which one of the injection valves undergoes such drift, although it is allowed to detect drift in injection characteristics as a whole of the cylinder injection valve and the intake passage injection valve.

PRIOR ART DOCUMENT(S)

Patent Document(s)

Patent Document 1: JP 2008-95532 A

SUMMARY OF THE INVENTION

According to one aspect of the present invention, an internal combustion engine is configured to: define a first region and a second region in a predetermined air-fuel ratio feedback control region in which feedback control of air-fuel ratio is implemented, wherein each combustion cycle in the first region employs fuel injection from only the first fuel injection valve, and wherein each combustion cycle in the second region employs fuel injection from the first fuel injection valve and the second fuel injection valve; set a ratio between a quantity of fuel injection from the first fuel injection valve and a quantity of fuel injection from the second fuel injection valve in the second region to a predetermined ratio constant independently of operating status; and implement a diagnosis on at least one of the first fuel injection valve and the second fuel injection valve, based on at least one of a first air-fuel ratio learning value learned in the first region and a second air-fuel ratio learning value learned in the second region.

According to this aspect of the present invention, the ratio of fuel injection quantities of the first fuel injection valve and the second fuel injection valve is set constant in the second region, regardless of operating status. This allows the diagnosis on the second fuel injection valve without forcing the second fuel injection valve to singly inject fuel.

MODE(S) FOR CARRYING OUT THE INVENTION

The following describes an embodiment of the present invention in detail, with reference to the drawings.

Figure 1:
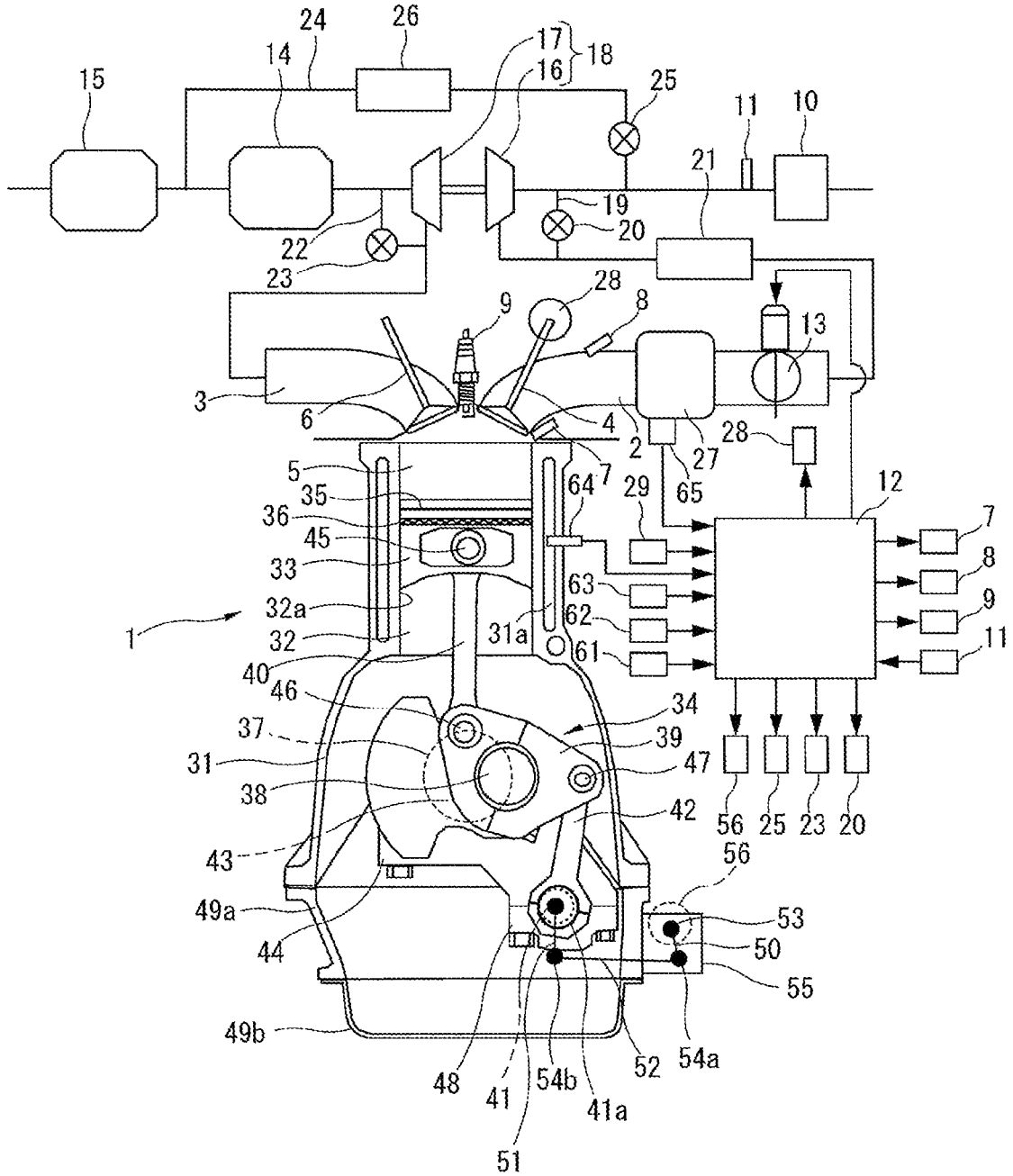
FIG. 1 is an illustrative diagram showing schematic configurations of an internal combustion engine according to the present invention.

FIG. 1 is an illustrative diagram showing schematic configurations of an internal combustion engine 1 according to the present invention.

Internal combustion engine 1 is a driving source to be mounted to a vehicle such as an automobile, and includes an intake passage 2 and an exhaust passage 3. Intake passage 2 is connected to a combustion chamber 5 via an intake valve 4. Exhaust passage 3 is connected to combustion chamber 5 via an exhaust valve 6.

Internal combustion engine 1 further includes a first fuel injection valve 7 structured to directly inject fuel into combustion chamber 5, and includes a second fuel injection valve 8 structured to inject fuel into intake passage 2 located upstream with respect to intake valve 4. The fuel injected from first fuel injection valve 7 and/or second fuel injection valve 8 is ignited with a spark plug 9 in combustion chamber 5.

Intake passage 2 is provided with: an air cleaner 10 structured to collect foreign substances in intake air; an air flow meter 11 structured to measure a quantity of the intake air; and an electric throttle valve 13 structured to have an opening degree controlled with a control signal from a controller unit 12.

Aft flow meter 11 is located upstream with respect to throttle valve 13. Air flow meter 11 includes a built-in temperature sensor, and is structured to measure a temperature of the intake air at an intake introduction port. Air cleaner 10 is located upstream with respect to air flow meter 11.

Exhaust passage 3 is provided with an upstream-side exhaust catalyst 14 such as a three way catalyst and a downstream-side exhaust catalyst 15 such as a NOx trapping catalyst. Downstream-side exhaust catalyst 15 is located downstream with respect to upstream-side exhaust catalyst 14.

Internal combustion engine 1 further includes a turbocharger 18 including a compressor 16 disposed in intake passage 2 and an exhaust turbine 17 disposed in exhaust passage 3, wherein compressor 16 and exhaust turbine 17 are coaxially arranged. Compressor 16 is located upstream with respect to throttle valve 13 and downstream with respect to air flow meter 11. Exhaust turbine 17 is located upstream with respect to upstream-side exhaust catalyst 14.

Intake passage 2 is connected to a recirculation passage 19. Recirculation passage 19 includes a first end connected to intake passage 2 at a section upstream with respect to compressor 16, and includes a second end connected to intake passage 2 at a section downstream with respect to compressor 16.

Recirculation passage 19 includes an electric recirculation valve 20 structured to allow a boost pressure to be exerted from the downstream section with respect to compressor 16 toward the upstream section with respect to compressor 16. Recirculation valve 20 may employ a so-called check valve structured to open only when a pressure in the downstream section with respect to compressor 16 is equal to or greater than a predetermined pressure.

Intake passage 2 is further provided with an intercooler 21 located downstream with respect to compressor 16. Intercooler 21 is structured to cool the intake air that has been compressed (or boosted) by compressor 16, in order to improve a charging efficiency of the intake air. Intercooler 21 is located downstream with respect to the second end (i.e. a downstream-side end) of recirculation passage 19 and upstream with respect to throttle valve 13.

Exhaust passage 3 is connected to an exhaust bypass passage 22 formed to connect an upstream section and a downstream section with respect to exhaust turbine 17, for bypassing of exhaust turbine 17. Exhaust bypass passage 22 includes a downstream-side end connected to exhaust passage 3 at a section upstream with respect to upstream-side exhaust catalyst 14, and includes an electric waste gate valve 23 structured to control a quantity of exhaust air flowing in exhaust bypass passage 22. Waste gate valve 23 allows a part of exhaust air flowing toward exhaust turbine 17 to bypass exhaust turbine 17 and flow into a section downstream with respect to exhaust turbine 17, and serves to control a boost pressure of internal combustion engine 1.

Internal combustion engine 1 is structured to perform Exhaust Gas Recirculation (EGR) in which a part of exhaust gas in exhaust passage 3 is leaded to flow into intake passage 2 (namely, recirculated) as EGR gas, and includes an EGR passage 24 formed to branch off from exhaust passage 3 and be connected to intake passage 2. EGR passage 24 includes a first end connected to exhaust passage 3 at a section between upstream-side exhaust catalyst 14 and downstream-side exhaust catalyst 15, and includes a second end connected to intake passage 2 at a section downstream with respect to air flow meter 11 and upstream with respect to compressor 16. EGR passage 24 includes an electric EGR valve 25 and an EGR cooler 26. EGR valve 25 is structured to control a quantity of EGR gas flowing in EGR passage 24. EGR cooler 26 is structured to cool the EGR gas. Incidentally, intake passage 2 is provided with a collector 27 as shown in FIG. 1.

Intake valve 4 is provided with a variable valve timing mechanism 28 serving as a valve timing varying mechanism structured to control valve timing of intake valve 4. Variable valve timing mechanism 28 according to the present embodiment is structured to delay valve opening timing and valve closing timing simultaneously by delaying a phase of a camshaft not shown. Accordingly, variable valve timing mechanism 28 is structured to, by simultaneously delaying the valve opening timing and the valve closing timing of the intake valve, vary a quantity of valve overlap that is overlap of an opening period of the intake valve and an opening period of the exhaust valve.

Such variable valve timing mechanism 28 has many known variations. The present invention is not limited to one employing a variable valve timing mechanism of a specific mode, provided that the variable valve timing mechanism is capable of varying the valve overlap quantity.

Variable valve timing mechanism 28 exemplarily includes: a sprocket disposed concentrically at a front end of the camshaft; and a hydraulic rotational actuator structured to cause the sprocket and the camshaft to relatively rotate with respect to each other within a predetermined range in angle. The sprocket is structured to coordinate with a crankshaft 37 described below, via a timing chain or a timing belt not shown. The relative rotation between the sprocket and the camshaft causes variation in phase of the camshaft with respect to a crank angle. The rotational actuator includes: an advancement-side oil pressure chamber for biasing to an advancement side by oil pressure, and a delay-side oil pressure chamber for biasing to a delay side by oil pressure. The phase of the camshaft is advanced or delayed by controlling oil pressures supplied to these oil pressure chambers via an oil pressure control valve not shown, with control signal from controller unit 12. The camshaft thus-controlled in variable valve timing mechanism 28 has an actual control position corresponding to actual valve timing. The actual control position is monitored by a cam angle sensor 29 structured to measure a rotational position of the camshaft. The oil pressure supply via the oil pressure control valve is under closed-loop control by controller unit 12 such that the actual control position monitored by cam angle sensor 29 agrees with a target control position determined depending on operating conditions.

Controller unit 12 stores and carries a map of the target control position which employs an engine load and an engine speed of internal combustion engine 1 as parameters representing the operating conditions. The target control position is determined based on this map. The target control position is basically characterized in that the valve timing is relatively in the delay side under a low engine speed and is advanced with increase in the engine speed.

The intake valve is basically set to have an opening timing prior to top dead center and a closing timing posterior to bottom dead center. When variable valve timing mechanism 28 has advanced the valve timing, the intake valve opening timing is advanced to become farther from the top dead center, increasing a valve overlap with exhaust valve 6, and the intake valve closing timing becomes nearer to the bottom dead center, increasing a volumetric efficiency. Although exhaust valve 6 in the exemplary drawing is not provided with a mechanism for varying valve timing, exhaust valve 6 according to the present invention may be provided with a variable valve timing mechanism in addition to variable valve timing mechanism 28 of intake valve 4.

Internal combustion engine 1 includes a variable compression ratio mechanism 34 structured to vary a mechanical compression ratio of internal combustion engine 1 by varying a top dead center position of a piston 33, wherein piston 33 is structured to reciprocate in a cylinder bore 32 of a cylinder block 31. Accordingly, internal combustion engine 1 has the mechanical compression ratio variable due to variation in slidable range of piston 33 being in sliding contact with an inner peripheral surface 32*a* of cylinder bore 32. In other words, internal combustion engine 1 has the mechanical compression ratio variable due to variation in slidable range of piston 33 with respect to the cylinder. The mechanical compression ratio depends on the top dead center position and a bottom dead center position of piston 33.

Piston 33 includes a first piston ring 35 and a second piston ring 36 disposed farther from a crown surface of piston 33 than first piston ring 35. First piston ring 35 and second piston ring 36 are so-called compression rings, and are structured to eliminate a gap between piston 33 and inner peripheral surface 32*a* of cylinder bore 32 for airtightness.

Variable compression ratio mechanism 34 employs a multi-link type piston crank mechanism in which piston 33 is in linkage with a crank pin 38 of crank shaft 37 via links. Variable compression ratio mechanism 34 includes: a lower link 39 mounted to crank pin 38 rotatably; an upper link 40 connecting lower link 39 to piston 33; a control shaft 41 including an eccentric shaft part 41*a*; and a control link 42 connecting eccentric shaft part 41*a* to lower link 39.

Crank shaft 37 includes crank pin 38 and crank journals 43. Crank journal 43 is rotatably supported between cylinder block 31 and a crank bearing bracket 44.

Upper link 40 includes a first end mounted rotatably to piston pin 45 and a second end connected rotatably to lower link 39 via a first connection pin 46. Control link 42 includes a first end connected rotatably to lower link 39 via a second connection pin 47, and a second end mounted rotatably to eccentric shaft part 41*a* of control shaft 41. First connection pin 46 and second connection pin 47 are press-fitted in and fixed to lower link 39.

Control shaft 41 is disposed parallel with crank shaft 37 and is rotatably supported by cylinder block 31. In detail, control shaft 41 is rotatably supported between crank bearing bracket 44 and a control shaft bearing bracket 48.

Cylinder block 31 is provided with an upper oil pan 49*a* mounted to a bottom of cylinder block 31 and a lower oil pan 49*b* mounted to a bottom of upper oil pan 49*a*.

Control shaft 41 is structured to be driven due to rotation of a drive shaft 53 which is transmitted via a first arm 50, a second arm 51, and an intermediary arm 52. Intermediary arm 52 serves as connection between first arm 50 to second arm 51. Drive shaft 53 is disposed outside of upper oil pan 49*a* and parallel with control shaft 41. First arm 50 is fixed to drive shaft 53.

Intermediary arm 52 includes a first end rotatably connected to first arm 50 via a pin 54*a*, and a second end rotatably connected to second arm 51 via a pin 54*b*, wherein second arm 51 is fixed to control shaft 41.

Drive shaft 53, first arm 50, and the first end of intermediary arm 52 is contained in a housing 55 mounted to an outer periphery of upper oil pan 49*a*.

Drive shaft 53 includes an end connected to an electric motor 56 via a speed reducer not shown. Electric motor 56 serves as an actuator structured to cause the rotation of drive shaft 53. The speed reducer is structured to reduce a rotational speed of drive shaft 53 with respect to a rotational speed of electric motor 56.

Due to rotation of electric motor 56, drive shaft 53 rotates, and intermediary arm 52 reciprocates along a plane perpendicular to drive shaft 53. The reciprocation of intermediary arm 52 causes a connection point between intermediary arm 52 and second arm 51 to swing, and then causes control shaft 41 to rotate. The rotation of control shaft 41 causes variation in rotational position of control shaft 41, and then causes variation in position of eccentric shaft part 41*a* serving as a supporting point for swing of control link 42. Thus, electric motor 56 is structured to cause variation in rotational position of control shaft 41, and variation in attitude of lower link 39, and variation in top dead center position and bottom dead center position of piston 33. This allows the mechanical compression ratio of internal combustion engine 1 to vary continuously.

The rotation of electric motor 56 is controlled by controller unit 12 such that the mechanical compression ratio of internal combustion engine 1 has a value corresponding to the operating conditions.

Controller unit 12 is a known digital computer including a CPU, a ROM, a RAM, and an input-output interface.

Controller unit 12 receives measurement signals from various sensors such as: air flow meter 11 described above; a crank angle sensor 61 structured to measure a crank angle of crank shaft 37; an accelerator-opening sensor 62 structured to measure a quantity of pressing-down of an accelerator; an oil temperature sensor 63 structured to measure a temperature of engine oil; a water temperature sensor 64 structured to measure a temperature of cooling-water; and a boost pressure sensor 65 structured to measure a boost pressure (or an intake pressure) in collector 27. Controller unit 12 is configured to calculate a required engine load of internal combustion engine 1, based on a measurement value of accelerator-opening sensor 62.

Crank angle sensor 61 serves to measure the engine speed of internal combustion engine 1.

Water temperature sensor 64 measures the temperature of cooling-water in a water jacket 31*a* formed in cylinder block 31.

Based on the measurement signals from the various sensors, controller unit 12 appropriately controls: a quantity and a timing of fuel injection from each of first fuel injection valve 7 and second fuel injection valve 8; an ignition timing of spark plug 9; the opening degree of throttle valve 13; an opening degree of recirculation valve 20; an opening degree of waste gate valve 23; an opening degree of EGR valve 25; and the mechanical compression ratio of internal combustion engine 1 defined by variable compression ratio mechanism 34.

The fuel injection quantity of each of first fuel injection valve 7 and second fuel injection valve 8 mentioned above is a quantity of fuel injected from the each of first fuel injection valve 7 and second fuel injection valve 8, during a combustion cycle including an intake stroke, a compression stroke, an expansion stroke, and an exhaust stroke.

Controller unit 12 is configured to implement controls as follows. In a predetermined first region A1 in which feedback control of air-fuel ratio is implemented, fuel is injected from first fuel injection valve 7 only. In a predetermined second region A2 existing within first region A1, fuel is injected from first fuel injection valve 7 and second fuel injection valve 8. In a predetermined high-revolution high-load region A3 in which open loop control of air-fuel ratio is implemented wherein high-revolution high-load region A3 is set outside of first region A1, fuel is injected from first fuel injection valve 7 and second fuel injection valve 8.

Figure 2:
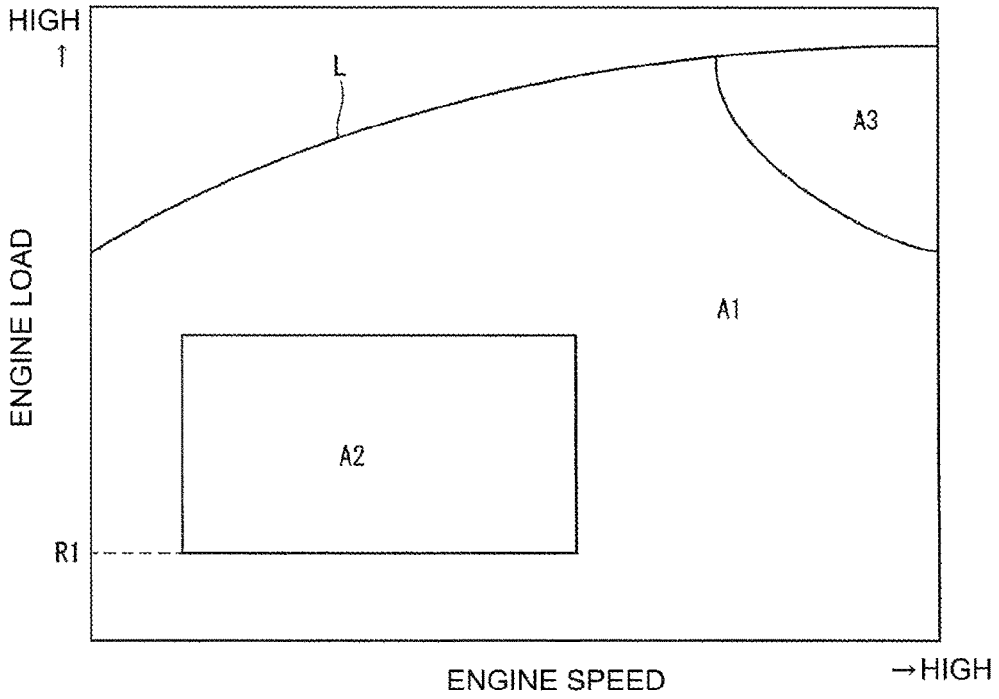
FIG. 2 is an operating region map employing an engine load and an engine speed as parameters.

First region A1, second region A2, and high-revolution high-load region A3 are predetermined as shown in FIG. 2. Which region an operating region of internal combustion engine 1 belongs depends on the engine load and the engine speed of internal combustion engine 1. Controller unit 12 has a map of operating region which employs as parameters the engine load and the engine speed of internal combustion engine 1. This map is the basis for determination of which region the operating region currently belongs. In addition, a characteristic curve L in FIG. 2 is a characteristic curve at full throttle. A sign R1 in FIG. 2 indicates a lower limit R1 of the engine load in second region A2.

In first region A1 or second region A2, the air-fuel ratio is under feedback control. In other words, first region A1 and second region A2 compose a predetermined air-fuel ratio feedback control region in which the air-fuel ratio is feedback-controlled based on operating status.

Each combustion cycle in the first region A1 employs fuel injection from only the first fuel injection valve (7). In other words, second fuel injection valve 8 does not inject fuel in first region A1.

Thus, controller unit 12 serves as a first region controller configured to perform the fuel injection with only the first fuel injection valve 7 during each combustion cycle in first region A1 in which the air-fuel ratio is feedback-controlled.

Each combustion cycle in the second region A2 employs fuel injection from the first fuel injection valve 7 and the second fuel injection valve 8. Furthermore, in second region A2, a ratio of a fuel quantity injected from first fuel injection valve 7 to a fuel quantity injected from second fuel injection valve 8 is set to a predetermined ratio constant independently of the operating status. For example, the ratio of the fuel injection quantity of first fuel injection valve 7 to the fuel injection quantity of second fuel injection valve 8 is set to 6:4.

Thus, controller unit 12 serves as a fuel injection controller configured to: during each combustion cycle in first region A1, perform the fuel injection with only the first fuel injection valve 7; during each combustion cycle in second region A2, perform the fuel injection with first fuel injection valve 7 and second fuel injection valve 8, and set the ratio of the fuel injection quantity of first fuel injection valve 7 to the fuel injection quantity of second fuel injection valve 8 to the predetermined ratio constant regardless of the operating status.

In other words, controller unit 12 serves as a second region controller configured to set the ratio of the fuel injection quantity of first fuel injection valve 7 to the fuel injection quantity of second fuel injection valve 8 to the predetermined ratio constant independently of the operating status, and control the fuel injection quantities of first fuel injection valve 7 and second fuel injection valve 8 such that the fuel injection quantities are at the predetermined ratio, during each combustion cycle in second region A2 set within first region A1 wherein in second region A2 the fuel injection is performed with first fuel injection valve 7 and second fuel injection valve 8.

High-revolution high-load region A3 is a region in which a fuel injection quantity required per combustion cycle exceeds a maximum injection quantity DIG_Qmax of fuel that first fuel injection valve 7 is capable of injecting per combustion cycle. In high-revolution high-load region A3, first fuel injection valve 7 injects fuel at maximum fuel injection quantity DIG_Qmax, and second fuel injection valve 8 injects fuel supplementarily to the fuel injection quantity from first fuel injection valve 7.

Thus, controller unit 12 serves as a high-revolution high-load region controller configured to set first fuel injection valve 7 to inject fuel at maximum fuel injection quantity DIG_Qmax, and set second fuel injection valve 8 to inject fuel supplementarily to the fuel injection quantity from first fuel injection valve 7, in order to perform the open loop control of air-fuel ratio, in high-revolution high-load region A3 outside of first region A1 wherein in high-revolution high-load region A3 the fuel injection quantity required per combustion cycle exceeds maximum injection quantity DIG_Qmax of fuel that first fuel injection valve 7 can inject per combustion cycle.

Figure 3:
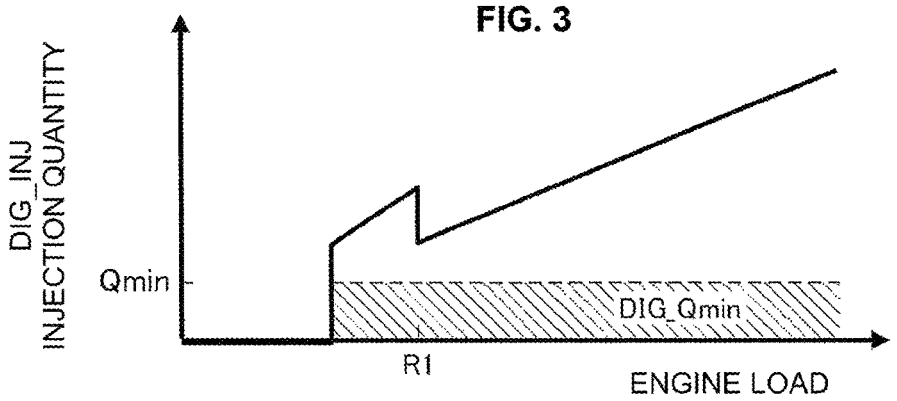
FIG. 3 is an illustrative chart schematically showing a correlation between the engine load and a fuel injection quantity of a first fuel injection valve.
Figure 4:
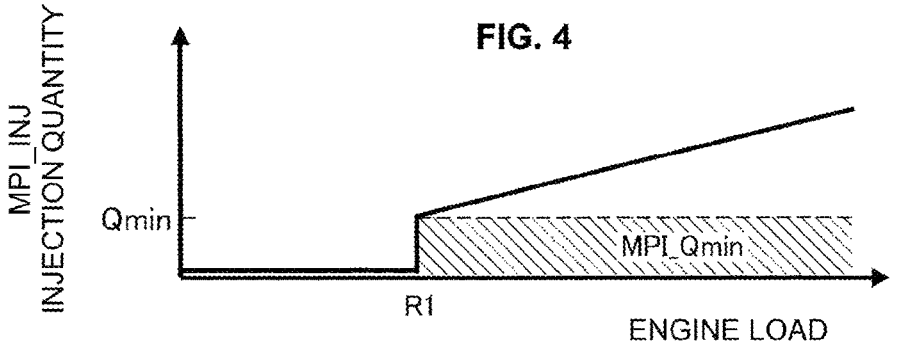
FIG. 4 is an illustrative chart schematically showing a correlation between the engine load and a fuel injection quantity of a second fuel injection valve.
Figure 5:
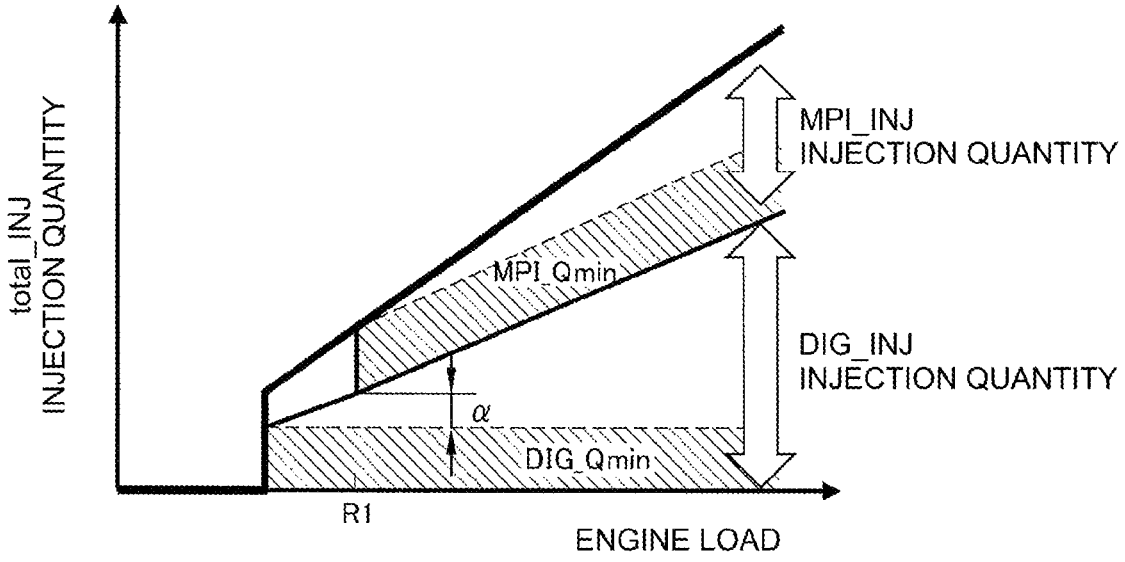
FIG. 5 is an illustrative chart schematically showing a correlation between the engine load and the fuel injection quantities.

Each of FIGS. 3 to 5 is an illustrative chart schematically showing a correlation between the engine load and the fuel injection quantity. FIG. 3 schematically shows a correlation between the engine load and the fuel injection quantity of first fuel injection valve 7: namely, DIG_INJ injection quantity. FIG. 4 schematically shows a correlation between the engine load and the fuel injection quantity of second fuel injection valve 8: namely, MPI_INJ injection quantity. FIG. 5 schematically shows a correlation between the engine load and the fuel injection quantity injected during a combustion cycle: namely, total_INJ injection quantity.

As shown in FIGS. 3 to 5, in second region A2, the fuel injection quantities of first fuel injection valve 7 and second fuel injection valve 8 are set at the predetermined ratio, such that each of the fuel injection quantities is equal to or greater than a minimum fuel injection quantity Qmin that is a quantity of fuel injected at a minimum fuel injection pulse width.

Accordingly, lower limit R1 of the engine load in second region A2 is set such that: the fuel injection quantity of first fuel injection valve 7 is equal to or greater than a minimum fuel injection quantity DIG_Qmin; and the fuel injection quantity of second fuel injection valve 8 is equal to or greater than a minimum fuel injection quantity MPI_Qmin.

Moreover, during each combustion cycle in second region A2, the fuel quantity supplied to combustion chamber 5 is at least equal to or greater than minimum fuel injection quantity DIG_Qmin of first fuel injection valve 7 injected at the minimum fuel injection pulse width.

Furthermore, in second region A2, each of the fuel injection quantities of first fuel injection valve 7 and second fuel injection valve 8 is maintained equal to or greater than the minimum fuel injection quantity Qmin injected at the minimum fuel injection pulse width, even if the each of the fuel injection quantity is reducingly corrected due to the air-fuel ratio feedback control.

Thus, second region A2 has engine load lower limit R1 determined to secure a margin $\alpha$ in fuel injection quantity which is set such that, even if the fuel injection quantity is reducingly corrected due to the air-fuel ratio feedback control, the fuel injection quantity of first fuel injection valve 7 is maintained equal to or greater than minimum fuel injection quantity DIG_Qmin, and the fuel injection quantity of second fuel injection valve 8 is maintained equal to or greater than minimum fuel injection quantity MPI_Qmin.

These configurations in second region A2 allows the injection apportionment ratio to be set to the predetermined constant ratio in second region A2.

Furthermore, second region A2 is set to include an operating region in which a valve overlap quantity to cause exhaust gas to blow back from combustion chamber 5 to intake passage 2 is increased.

This serves to suppress an injection port of second fuel injection valve 8 from being clogged, utilizing the blow back of exhaust gas from combustion chamber 5 to intake passage 2.

Each of first fuel injection valve 7 and second fuel injection valve 8 may undergo drift in injection characteristics with respect to designed settings (i.e. factory settings), due to deterioration by heat, clogging at a nozzle tip, etc.

In view of this, controller unit 12 is configured to implement a diagnosis on first fuel injection valve 7 and/or second fuel injection valve 8 at a predetermined timing, based on a first air-fuel ratio learning value learned in first region A1 and/or a second air-fuel ratio learning value learned in second region A2. Thus, controller unit 12 serves as a diagnoser configured to implement the diagnosis on first fuel injection valve 7 and/or second fuel injection valve 8, based on the first air-fuel ratio learning value and/or the second air-fuel ratio learning value. The diagnosis on first fuel injection valve 7 and/or second fuel injection valve 8 are/is implemented in the feedback control region.

Each of the first air-fuel ratio learning value and the second air-fuel ratio learning value is a quantity of deviation from an appropriate air-fuel ratio according to the air-fuel ratio feedback control. In other words, each of the first air-fuel ratio learning value and the second air-fuel ratio learning value is a quantity of drift in air-fuel ratio in the air-fuel ratio feedback control.

The predetermined timing mentioned above may be a timing after the first air-fuel ratio learning value is learned, or a timing after the second air-fuel ratio learning value is learned.

In case that, for example, the first air-fuel ratio learning value is equal to or greater than a predetermined value Ka set beforehand, controller unit 12 determines that first fuel injection valve 7 is in trouble.

In case that the second air-fuel ratio learning value is equal to or greater than a predetermined value Kb set beforehand, controller unit 12 determines that one of first fuel injection valve 7 and second fuel injection valve 8 is in trouble.

In case that the second air-fuel ratio learning value is equal to or greater than the predetermined value Kb and the first air-fuel ratio learning value is less than predetermined value Ka, controller unit 12 determines that second fuel injection valve 8 is in trouble.

In case that the second air-fuel ratio learning value is less than the predetermined value Kb and the first air-fuel ratio learning value is equal to or greater than the predetermined value Ka, controller unit 12 determines that first fuel injection valve 7 is in trouble.

The diagnosis on second fuel injection valve 8 can be performed in comparison of the first air-fuel ratio learning value and the second air-fuel ratio learning value, when the ratio of the fuel injection quantity of first fuel injection valve 7 to the fuel injection quantity of second fuel injection valve 8 in second region A2, i.e. the apportionment ratio of fuel injection quantity between the two fuel injection valves 7 and 8 in second region A2, is constant independently of the operating status.

Accordingly, the diagnosis on second fuel injection valve 8 can be performed without implementing solo fuel injection by second fuel injection valve 8.

This allows determination of whether second fuel injection valve 8 undergoes the drift in injection characteristics with respect to expected injection characteristics.

Furthermore, the diagnosis of whether second fuel injection valve 8 is in trouble can be performed without forcing second fuel injection valve 8 to singly inject fuel.

If the apportionment ratio varies depending on the operating status in second region A2, it is needed to implement the leaning of air-fuel ratio learning values and the air-fuel ratio feedback control in accordance with the variation in apportionment ratio. This is because when the drift in injection characteristics of the fuel injection valve due to the variation in apportionment ratio occurs, a flow quantity variation rate of fuel injection quantity as a whole of the fuel injection valves varies depending on the variation in apportionment ratio.

Accordingly, in case that the air-fuel ratio feedback control is implemented in a region in which the learning of air-fuel ratio is incomplete, the air-fuel ratio feedback control does not reflects the air-fuel ratio learning values. This may cause deterioration in emission.

In contrast, according to the above embodiment, the ratio of the fuel injection quantity of first fuel injection valve 7 to the fuel injection quantity of second fuel injection valve 8 in second region A2, i.e. the apportionment ratio of fuel injection quantity between the two fuel injection valves 7 and 8 in second region A2, is constant independently of the operating status. Thus, the two fuel injection valves 7 and 8 has a common drift rate in fuel injection quantity during the air-fuel ratio feedback control in second region A2.

In other words, when considering an entirety of second region A2 as an unit learning region, it is allowed to use a certain drift rate in fuel injection quantity in second region A2 as an unique air-fuel ratio learning value in second region A2. In second region A2, this facilitates performing feedback in the air-fuel ratio feedback control, and serves to quickly complete the air-fuel ratio learning and suppress the deterioration in emission.

Figure 6:
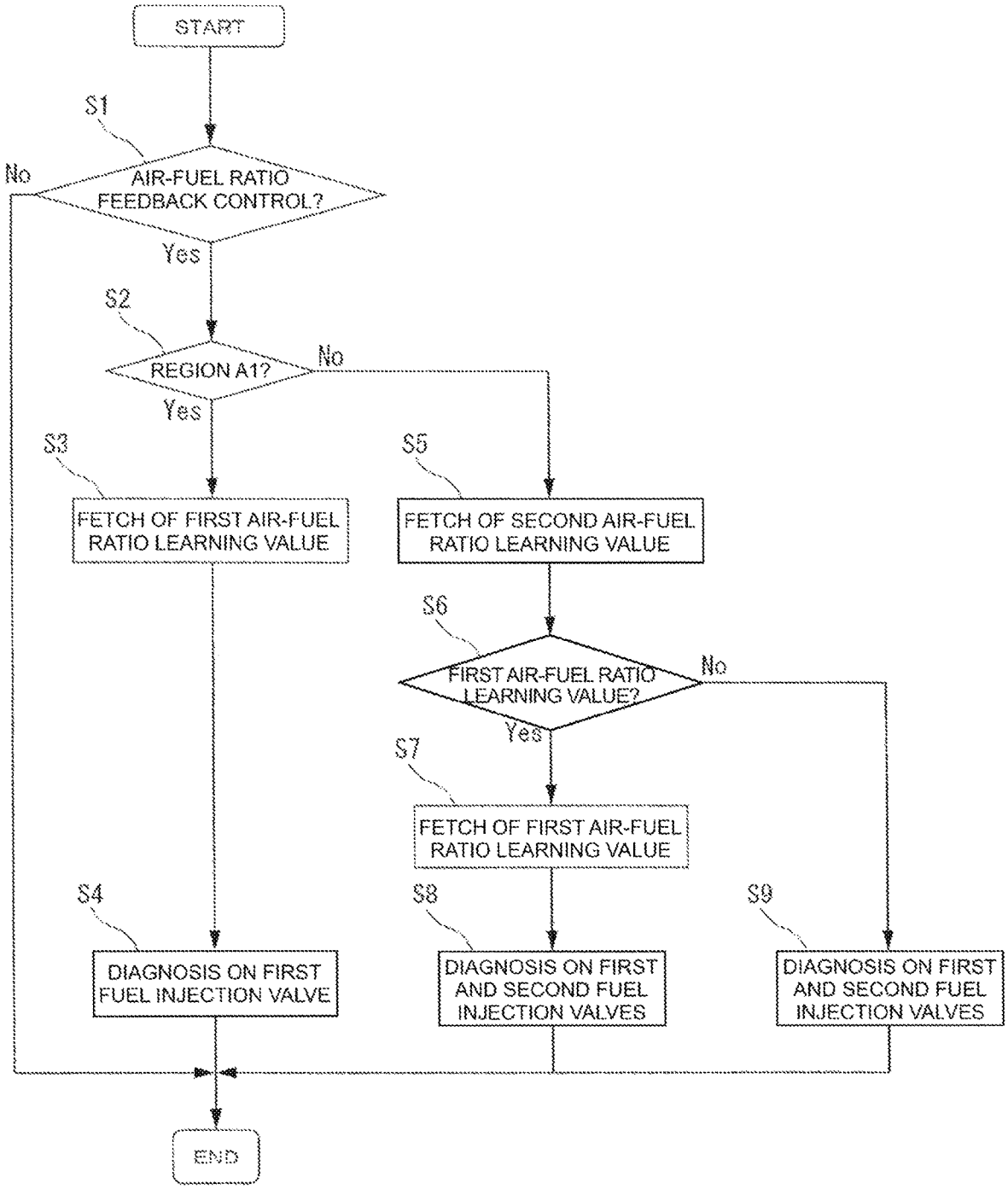
FIG. 6 is a flow chart showing an exemplary control flow upon diagnosis on fuel injection valves.

FIG. 6 is a flow chart showing an exemplary control flow upon the diagnosis on first fuel injection valve 7 and/or second fuel injection valve 8. FIG. 6 shows a case in which the diagnosis is implemented at a timing after the air-fuel ratio learning value is learned.

Step S1 is determination of whether the air-fuel ratio feedback control is in operation. If the air-fuel ratio feedback control is in operation, step S2 is executed subsequent to step S1. If the air-fuel ratio feedback control is not in operation, the present routine is ended.

Step S2 is determination of whether the operating region belongs first region A1. If the operating region belongs first region A1, step S3 is executed subsequent to step S2. If the operating region does not belong first region A1, step S5 is executed subsequent to step S2.

Step S3 is fetch of the first air-fuel ratio learning value. Step S4 is implementation of the trouble diagnosis on first fuel injection valve 7 based on the first air-fuel ratio learning value fetched in step S3.

Step S5 is fetch of the second air-fuel ratio learning value. Step S6 is determination of whether there is the first air-fuel ratio learning value already learned. If there is the first air-fuel ratio learning value already learned, step S7 is executed subsequent to step S6. If there is not the first air-fuel ratio learning value already learned, step S9 is executed subsequent to step S6.

Step S7 is fetch of the first air-fuel ratio learning value already learned. Step S8 is implementation of the trouble diagnosis on first fuel injection valve 7 and second fuel injection valve 8, based on the second air-fuel ratio learning value fetched in step S5 and the first air-fuel ratio learning value fetched in step S7. Step S8 serves to determine whether each of first fuel injection valve 7 and second fuel injection valve 8 is in trouble.

Step S9 is implementation of the trouble diagnosis on first fuel injection valve 7 and second fuel injection valve 8 based on the second air-fuel ratio learning value fetched in step S5. In case that at least one of first fuel injection valve 7 and second fuel injection valve 8 is in trouble, step S9 serves to determine that at least one of first fuel injection valve 7 and second fuel injection valve 8 is in trouble. In other words, step S9 does not provide an individual trouble diagnosis on each of first fuel injection valve 7 and second fuel injection valve 8, but allows determination of whether there is a trouble.

In addition, controller unit 12 according to the above embodiment may be modified to calculate a mock learning value for second fuel injection valve 8 from the first air-fuel ratio learning value and the second air-fuel ratio learning value, and implement the diagnosis on second fuel injection valve 8 on the basis of the calculated mock learning value. In such case, controller unit 12 serves as a mock learning value calculator configured to calculate the mock learning value for second fuel injection valve 8 from the first air-fuel ratio learning value and the second air-fuel ratio learning value, and serves as a diagnoser configured to implement the diagnosis on second fuel injection valve 8 on the basis of the calculated mock learning value.

For example, controller unit 12 may be configured to determine that second fuel injection valve 8 has a deviation in injection characteristics, in response to satisfaction of a condition that the mock learning value for second fuel injection valve 8 is equal to or greater than a predetermined value M set beforehand. The mock learning value for second fuel injection valve 8 may be calculated as a difference between the first air-fuel ratio learning value and the second air-fuel ratio learning value.

The embodiment described above relates to a diagnostic method for internal combustion engine and a diagnostic device for internal combustion engine.

The invention claimed is:

1. A diagnostic method for an internal combustion engine that includes a first fuel injection valve structured to inject fuel directly into a cylinder of the internal combustion engine and includes a second fuel injection valve structured to inject fuel into an intake passage connected to the cylinder, the diagnostic method comprising:

defining a first region and a second region in a predetermined air-fuel ratio feedback control region in which feedback control of air-fuel ratio is implemented, wherein:

each combustion cycle in the first region employs fuel injection from only the first fuel injection valve; and each combustion cycle in the second region employs fuel injection from the first fuel injection valve and the second fuel injection valve;

setting a ratio between a quantity of fuel injection from the first fuel injection valve and a quantity of fuel injection from the second fuel injection valve in the second region to a predetermined ratio constant independently of operating status; and implementing a diagnosis on at least one of the first fuel injection valve and the second fuel injection valve, based on at least one of a first air-fuel ratio learning value learned in the first region and a second air-fuel ratio learning value learned in the second region.

2. The diagnostic method as claimed in claim 1, the method further comprising:

determining that one of the first fuel injection valve and the second fuel injection valve is in trouble, in case that the second air-fuel ratio learning value is equal to or greater than a predetermined value Kb.

3. The diagnostic method as claimed in claim 1, the method further comprising:

determining that the second fuel injection valve is in trouble, in case that the second air-fuel ratio learning value is equal to or greater than a predetermined value Kb and the first air-fuel ratio learning value is less than a predetermined value Ka.

4. The diagnostic method as claimed in claim 1, wherein:

the internal combustion engine further includes a valve timing varying mechanism structured to vary a quantity of valve overlap that is overlap of an intake valve opening period and an exhaust valve opening period; and the second region includes a region in which the valve overlap to cause exhaust gas to blow back from the cylinder to the intake passage is increased.

5. The diagnostic method as claimed in claim 1, wherein in the second region, the ratio between the quantity of fuel injection from the first fuel injection valve and the quantity of fuel injection from the second fuel injection valve is set to the predetermined ratio such that each of the fuel injection quantities is equal to or greater than a minimum fuel injection quantity injected at a minimum fuel injection pulse width.

6. The diagnostic method as claimed in claim 1, wherein in the second region, a quantity of fuel supplied to the cylinder during each combustion cycle is set at least equal to or greater than a minimum fuel injection quantity of the first fuel injection valve injected at a minimum fuel injection pulse width.

7. The diagnostic method as claimed in claim 1, wherein in the second region, each of the quantity of fuel injection from the first fuel injection valve and the quantity of fuel injection from the second fuel injection valve is maintained equal to or greater than a minimum fuel injection quantity injected at a minimum fuel injection pulse width, even if the each of the quantities of fuel injection is reducingly corrected due to the air-fuel ratio feedback control.

8. A diagnostic method for an internal combustion engine that includes a first fuel injection valve structured to inject fuel directly into a cylinder of the internal combustion engine and includes a second fuel injection valve structured to inject fuel into an intake passage connected to the cylinder, the diagnostic method comprising:

defining a first region in which feedback control of air-fuel ratio is implemented;

injecting fuel from only the first fuel injection valve during each combustion cycle in the first region;

defining a high-revolution high-load region outside of the first region, wherein in the high-revolution high-load region, open loop control of air-fuel ratio is implemented, and a fuel injection quantity required per combustion cycle exceeds a maximum fuel injection quantity that the first fuel injection valve is capable of injecting per combustion cycle;

in the high-revolution high-load region, setting the first fuel injection valve to inject fuel at the maximum fuel injection quantity, and setting the second fuel injection valve to inject fuel supplementarily to the fuel injection quantity from the first fuel injection valve;

defining a second region within the first region;

during each combustion cycle in the second region, injecting fuel from the first fuel injection valve and the second fuel injection valve;

during each combustion cycle in the second region, setting a ratio between a quantity of fuel injection from the first fuel injection valve and a quantity of fuel injection from the second fuel injection valve to a predetermined ratio constant independently of operating status;

calculating a mock learning value for the second fuel injection valve from a first air-fuel ratio learning value learned in the first region and a second air-fuel ratio learning value learned in the second region; and implementing a diagnosis on the second fuel injection valve, based on the mock learning value.

9. A diagnostic device for an internal combustion engine, the diagnostic device comprising:

a first fuel injection valve structured to inject fuel directly into a cylinder of the internal combustion engine;

a second fuel injection valve structured to inject fuel into an intake passage connected to the cylinder;

a fuel injection controller configured to:

inject fuel from only the first fuel injection valve during each combustion cycle in a predetermined first region defined in a predetermined air-fuel ratio feedback control region in which feedback control of air-fuel ratio is implemented;

inject fuel from the first fuel injection valve and the second fuel injection valve during each combustion cycle in a predetermined second region defined in the air-fuel ratio feedback control region; and set a ratio between a fuel injection quantity from the first fuel injection valve and a fuel injection quantity from the second fuel injection valve in the second region, to a predetermined ratio constant independently of operating status; and a diagnoser configured to implement a diagnosis on at least one of the first fuel injection valve and the second fuel injection valve, based on at least one of a first air-fuel ratio learning value learned in the first region and a second air-fuel ratio learning value learned in the second region.

10. A diagnostic device for an internal combustion engine, the diagnostic device comprising:

a first fuel injection valve structured to inject fuel directly into a cylinder of the internal combustion engine;

a second fuel injection valve structured to inject fuel into an intake passage connected to the cylinder;

a first region controller configured to inject fuel from only the first fuel injection valve during each combustion cycle in a first region in which feedback control of air-fuel ratio is implemented;

a high-revolution high-load region controller configured to:

in a high-revolution high-load region defined outside of the first region wherein in the high-revolution high-load region, a fuel injection quantity required per combustion cycle exceeds a maximum fuel injection quantity that the first fuel injection valve is capable of injecting per combustion cycle;

set the first fuel injection valve to inject fuel at the maximum fuel injection quantity; and set the second fuel injection valve to inject fuel supplementarily to the fuel injection quantity from the first fuel injection valve; and implement open loop control of air-fuel ratio;

a second region controller configured to:

during each combustion cycle in a second region defined within the first region, inject fuel from the first fuel injection valve and the second fuel injection valve;

set a ratio between a fuel injection quantity from the first fuel injection valve and a fuel injection quantity from the second fuel injection valve to a predetermined ratio constant independently of operating status; and control the fuel injection quantities from the first fuel injection valve and the second fuel injection valve to be at the predetermined ratio;

a mock learning value calculator configured to calculate a mock learning value for the second fuel injection valve from a first air-fuel ratio learning value learned in the first region and a second air-fuel ratio learning value learned in the second region; and a diagnoser configured to implement a diagnosis on the second fuel injection valve, based on the mock learning value.

* * * * *